US010816207B2

(12) United States Patent
Fryer

(10) Patent No.: US 10,816,207 B2
(45) Date of Patent: Oct. 27, 2020

(54) FUEL NOZZLE WITH HELICAL FUEL PASSAGE

(71) Applicant: PRATT & WHITNEY CANADA CORP., Longueuil (CA)

(72) Inventor: Michael A. Fryer, Oakville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 257 days.

(21) Appl. No.: 15/896,810

(22) Filed: Feb. 14, 2018

(65) Prior Publication Data

US 2019/0249877 A1 Aug. 15, 2019

(51) Int. Cl.
*F23R 3/28* (2006.01)

(52) U.S. Cl.
CPC ..... *F23R 3/283* (2013.01)

(58) Field of Classification Search
CPC .... F23R 3/28; F23R 3/283; F23R 3/32; F23R 3/36; F02C 7/222; F05D 2250/25
See application file for complete search history.

(56) References Cited

U.S. PATENT DOCUMENTS

| | | | | |
|---|---|---|---|---|
| 3,159,971 | A * | 12/1964 | Moebius | F23R 3/283 60/740 |
| 7,043,922 | B2 * | 5/2006 | Thompson | F02C 7/222 239/404 |
| 7,174,717 | B2 | 2/2007 | Prociw | |
| 7,712,313 | B2 | 5/2010 | Kojovic et al. | |
| 8,443,608 | B2 | 5/2013 | Williams | |
| 2009/0255257 | A1 * | 10/2009 | McMasters | B23P 6/007 60/734 |
| 2015/0135716 | A1 * | 5/2015 | Ginessin | F23R 3/28 60/737 |
| 2016/0236271 | A1 | 8/2016 | Xu | |
| 2017/0138266 | A1 * | 5/2017 | Caples | F02C 7/222 |

* cited by examiner

*Primary Examiner* — Carlos A Rivera
(74) *Attorney, Agent, or Firm* — Norton Rose Fulbright Canada LLP

(57) ABSTRACT

A fuel nozzle for a gas turbine engine includes a stem having a monolithic stem body extending longitudinally between a first end and a second end. The monolithic stem body has a radially outer surface and at least one helical fuel passage extending through the monolithic stem body and disposed inwardly from the radial outer surface. The at least one helical fuel passage extends helically through the monolithic stem body about a passage axis extending between the first and second ends.

17 Claims, 6 Drawing Sheets

FUEL NOZZLE WITH HELICAL FUEL PASSAGE

TECHNICAL FIELD

The present disclosure relates generally to gas turbine engines and, more particularly, to fuel nozzles for gas turbine engines.

BACKGROUND

In a gas turbine engine, the areas surrounding the combustor have elevated temperatures because of the heat given off by the combustor when fuel is combusted therein, and because of the heated compressed air delivered from the compressor. This heat energy affects components surrounding the combustor, such as fuel nozzles. The internal passages of such fuel nozzles are thus vulnerable to this heat energy.

SUMMARY

In one aspect, there is provided a fuel nozzle for a gas turbine engine, the fuel nozzle comprising: a stem having a monolithic stem body extending longitudinally between a first end and a second end, the monolithic stem body having a radially outer surface and at least one helical fuel passage extending through the monolithic stem body and disposed inwardly from the radial outer surface, the at least one helical fuel passage extending helically through the monolithic stem body about a passage axis extending between the first and second ends.

In another aspect, there is provided a gas turbine engine, comprising: an annular engine case, and a combustor; and fuel nozzle, comprising: a flange secured to the engine case, and a stem extending from the flange to a distal nozzle tip extending through an opening in the combustor, the stem having a monolithic stem body having a radially outer surface and at least one helical fuel passage extending through the monolithic stem body and disposed inwardly from the radial outer surface, the at least one helical fuel passage extending helically through the monolithic stem body about a passage axis extending between longitudinally-opposed first and second ends of the monolithic stem body.

In a further aspect, there is provided a method of manufacturing a fuel nozzle for a gas turbine engine, the method comprising: forming a monolithic stem body, the monolithic stem body extending axially along a longitudinal stem axis between an outer end and an inner end, the outer end having a fuel inlet and adapted to be secured to a casing of the gas turbine engine and the inner end having a spray tip of the fuel nozzle mounted thereto, including integrally forming at least one internal helical fuel passage within the monolithic stem body, the at least one internal helical fuel passage extending axially through the monolithic stem body between the fuel inlet and the spray tip, the at least one internal helical fuel passage disposed radially inwardly from a radially-outer surface of the monolithic stem body and extending helically about a passage axis extending between the fuel inlet and the spray tip.

DESCRIPTION OF THE DRAWINGS

Reference is now made to the accompanying figures in which.

DETAILED DESCRIPTION

Figure 1A:
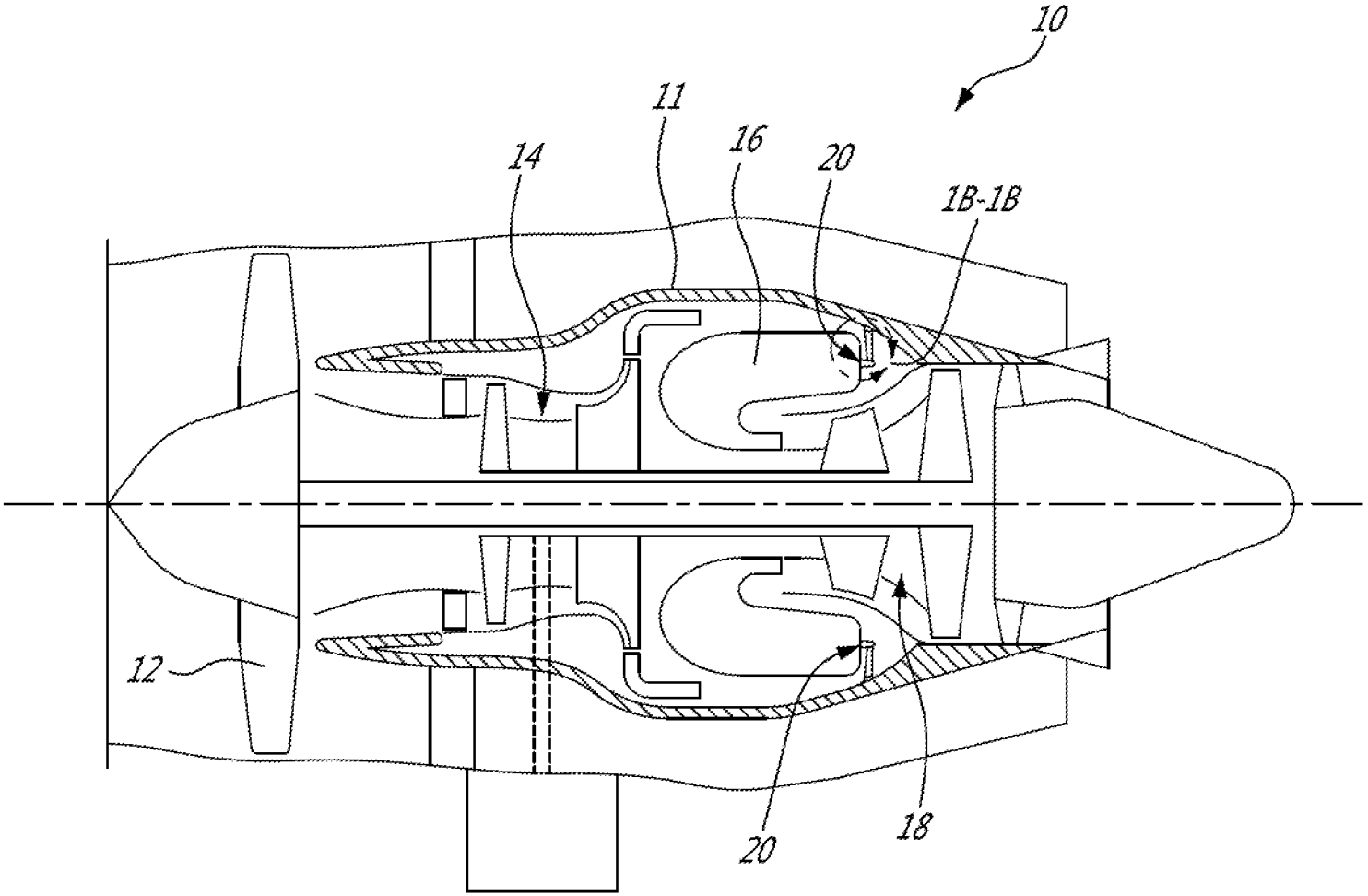
FIG. 1A is a schematic cross-sectional view of a gas turbine engine.

FIG. 1A illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 1B:
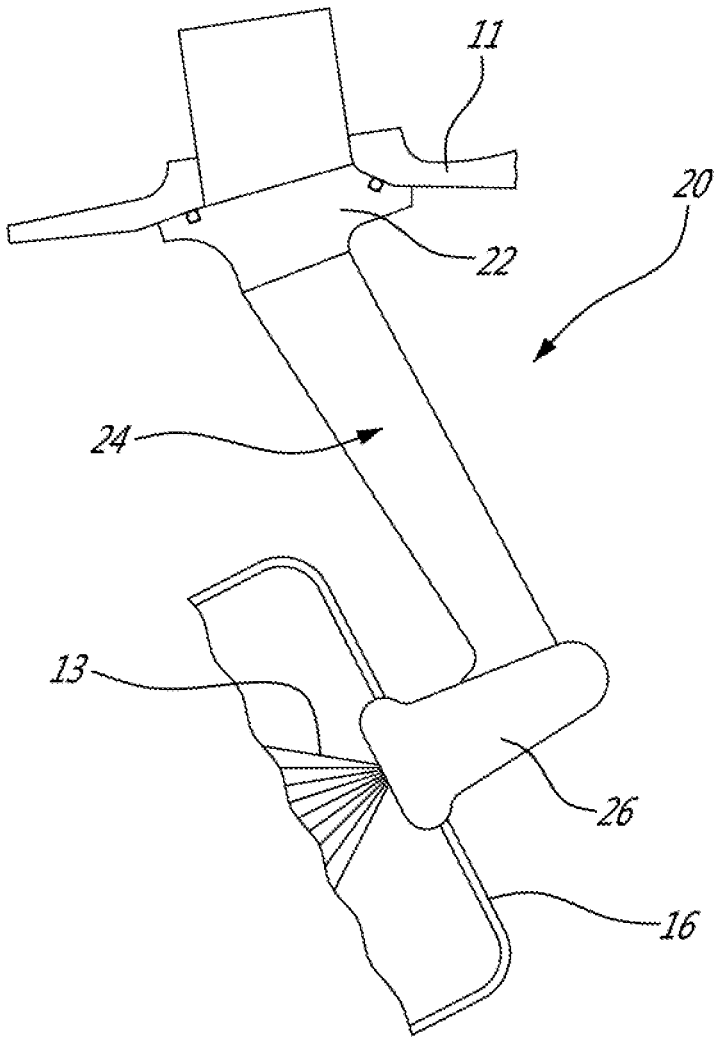
FIG. 1B is a perspective view of a fuel nozzle of the gas turbine engine, taken from region 1B-1B of FIG. 1A, wherein the fuel nozzle is shown mounted between a casing and a combustor of the gas turbine engine.

Referring to FIGS. 1A and 1B, the gas turbine engine 10 has fuel nozzles 20 or injectors mounted between an annular case 11 of the gas turbine engine 10 and the combustor 16. FIG. 1B shows an embodiment of one of the fuel nozzles 20. The illustrated fuel nozzle 20 comprises three parts secured together, namely, a flange 22 which is secured to the case 11, a stem 24 extending from the flange 22, and a nozzle tip 26 located at the end of the stem 24 and having a portion connected to the combustor 16. The nozzle tip 26 is positioned within an opening in the combustor 16. Fuel 13 is supplied at the flange 22 of the fuel nozzle 20 from a manifold. The fuel 13 exits the fuel nozzle 20 at the nozzle tip 26, where it is ejected typically as a spray into the combustor 16 and ignited to generate heat.

Figure 2A:
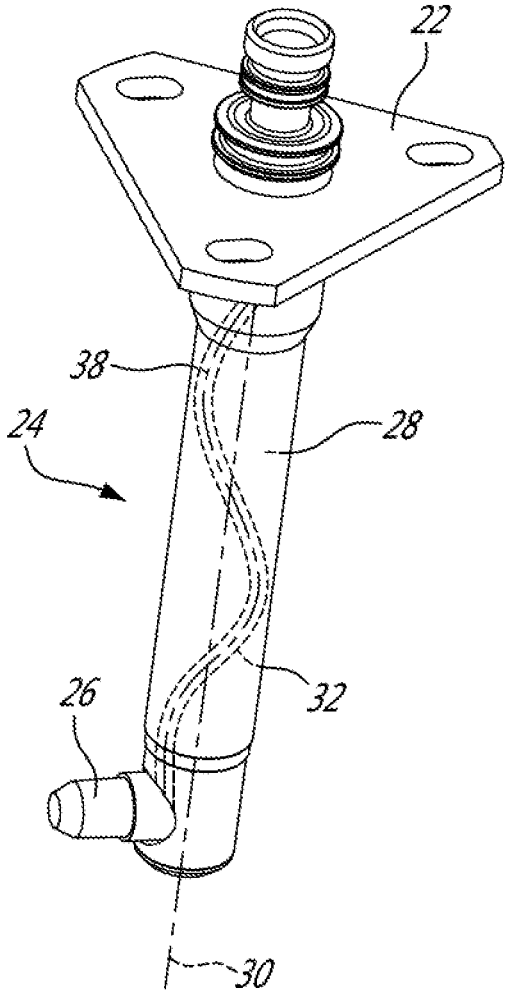
FIG. 2A is a perspective view of a stem portion of the fuel nozzle of FIG. 1B, in accordance with one aspect of the present disclosure.
Figure 2B:
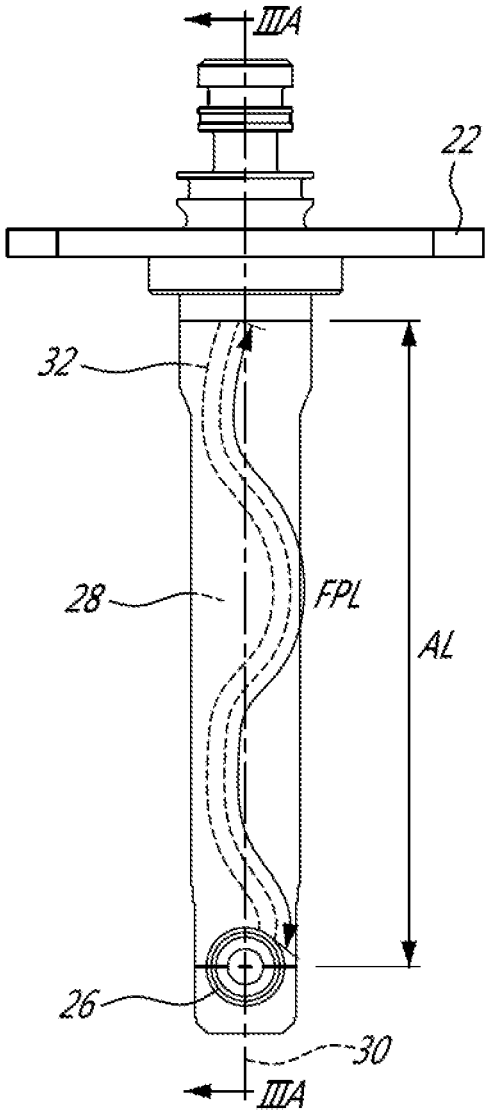
FIG. 2B is a front elevational view of the stem of the fuel nozzle of FIG. 2A.

Referring to FIGS. 2A and 2B, the stem 24 has a monolithic stem body 28 that forms the corpus of the stem 24 and provides structure thereto. The monolithic stem body 28 (sometimes referred to herein simply as "stem body 28") is elongated, and extends along a longitudinal stem center axis 30, between a first end (e.g. the outer end having the flange 22) and a second end (e.g. the inner end having the nozzle tip 26). The stem body 28 therefore has an axial length AL measured parallel to the stem center axis 30. The stem body 28 forms the central core of the tubular stem 24, and is the component of the stem 24 that is radially closest to the stem center axis 30.

As can be seen, the stem 28 includes an internal fuel circuit. More particularly, the stem body 28 has, in the depicted embodiment, a single, internal helical fuel passage 32 extending through the stem body 28 along the entire axial length AL. Fuel circulates in the helical fuel passage 32 (sometimes referred to herein simply as "fuel passage 32") from an inlet near the flange 22 of the fuel nozzle 22 to a manifold in fluid communication with the outlet of the nozzle tip 26. The fuel passage 32 has a fuel passage length FPL being greater than the axial length AL of the stem body. In an alternate embodiment, and as described in greater detail below, the stem body 28 has more than one fuel passage 32. In an alternate embodiment, the one or more fuel passages 32 extend through the stem body 28 along only part of the axial length AL of the stem body 28.

Figure 3A:
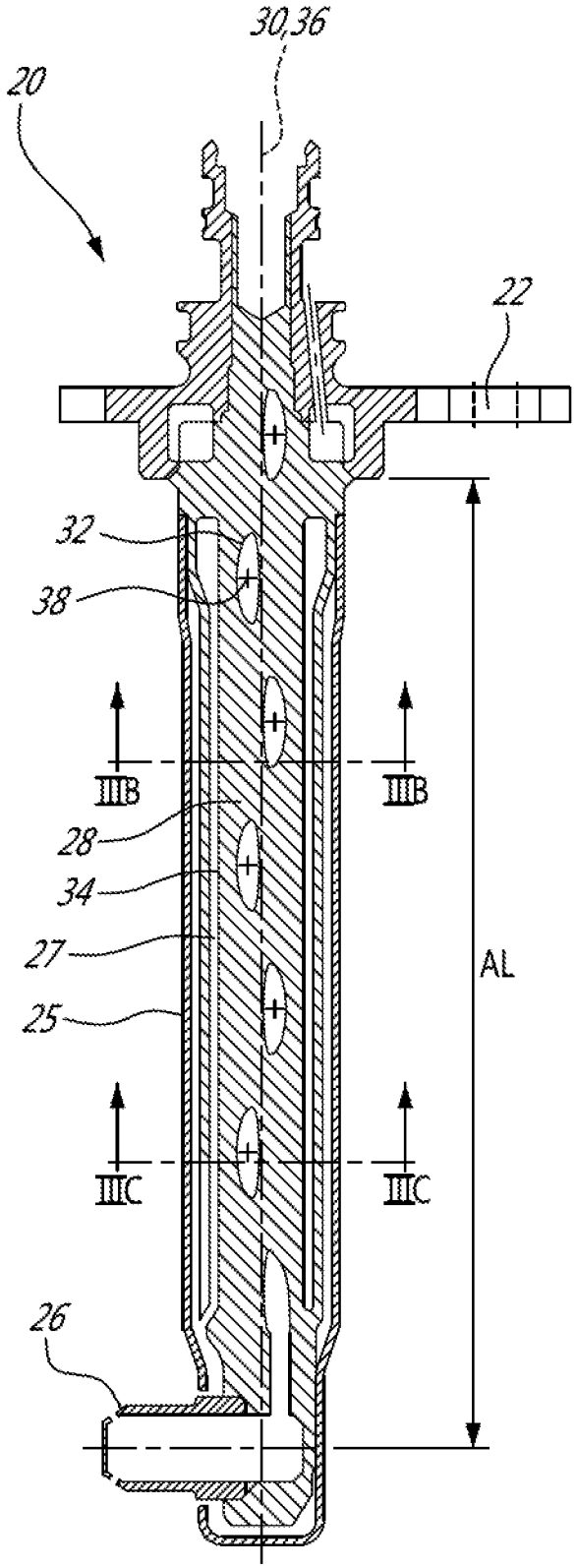
FIG. 3A is a cross-sectional view of the stem of the fuel nozzle of FIG. 1B, taken along the line IIIA-IIIA in FIG. 2B.
Figure 3B:
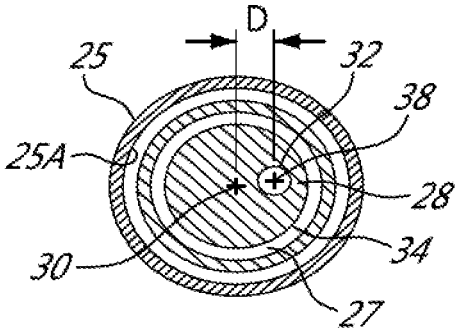
FIG. 3B is a cross-sectional view of the stem of the fuel nozzle of FIG. 1B, taken along the line IIIB-IIIB in FIG. 3A.
Figure 3C:
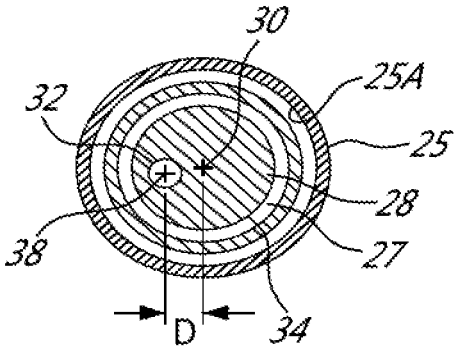
FIG. 3C is a cross-sectional view of the stem of the fuel nozzle of FIG. 1B, taken along the line IIIC-IIIC in FIG. 3A.

Referring to FIGS. 3A to 3C, the stem body 28 has an outer surface 34 that is spaced radially outwardly from the stem center axis 30. By "radially outwardly", it is understood that the distance of any point on the outer surface 34 is measured along a line that is normal to the stem center axis 30 and extends therefrom to the point on the outer surface 34. The outer surface 34 in the depicted embodiment is the radially outermost surface of the stem body 28.

The fuel passage 32 is positioned radially inwardly from the outer surface 34 of the stem body 28, and radially outwardly of the stem center axis 30. The fuel passage 32 is therefore an internal conduit that is insulated from the heat surrounding the fuel nozzle 20 by the material of the stem body 28. In the depicted embodiment, the stem body 28 is a solid, monolithic, body. The monolithic stem body 28 is therefore integrally formed as a single component, and has a one-piece construction. The stem body 28 is free of any apertures or grooves except for the fuel passage 32. In contrast to some convention fuel nozzles, the stem body 28 is free of a central bore or passage that is parallel and coaxial with the stem center axis 30. The stem body 28, in the depicted embodiment, has a radial thickness of the stem body 28 that is defined between the fuel passage 32 and the outer surface 34 of the stem body 28. The radial thickness of material of the stem body 28 helps to shield and insulate the fuel passage 32, and may contribute to lowering heat transfer from the environment surrounding the fuel nozzle 20 to the fuel passage 32.

Still referring to FIGS. 3A to 3C, the fuel passage 32 is a helical passage over the axial length AL through the stem body 28 (see FIGS. 2A and 2B as well). From its inlet to its outlet, the fuel passage 32 takes a helical course over the axial length AL of the stem body 28, such that portions of the fuel passage 32 axially overlap one another. From its inlet to its outlet, the fuel passage 32 takes a circular or elliptical course through the stem body 28 about a passage axis 36. The passage axis 36 of the fuel passage 32 is the axis about which the fuel passage 32 is helically wound. The fuel passage 32 extends helically such that it completes at least one revolution over the axial length AL of the stem body 28. By "revolution", it is understood that a first point along the fuel passage 32 will have a first radial position with respect to the passage axis 36, and at least a second portion along the fuel passage 32 which is axially spaced from the first portion will have a second radial position with respect to the passage axis 36, where the first and second radial positions are the same. A non-limiting list of other adjectives used to describe the winding configuration of the fuel passage 32 includes curled, coiled, and wrapped.

The helical fuel passage 32 has a pitch. The pitch of the fuel passage 32 is defined as the number of revolutions made by the helical fuel passage 32 over a unit length. In the depicted embodiment, the pitch is constant over the axial length AL of the stem body 28. In an alternate embodiment, the pitch varies over the axial length AL. The pitch impacts a ratio of fuel passage volume to stem volume. As explained below, the value of this volumetric ratio may impact the heat transferred to the fuel passage 32 from the hot environment surrounding the fuel nozzle 20.

In the depicted embodiment, the passage axis 36 is collinear with the stem center axis 30. Therefore, in the depicted embodiment, the fuel passage 32 has a helical form through the stem body 28 about the stem center axis 30 over the axial length AL of the stem body 28. As will be described in greater detail below, other locations for the passage axis 36 are within the scope of the present disclosure.

In conventional fuel nozzles having straight or linear fuel passages, heat is transferred from the environment surrounding the fuel nozzle through the walls of the stem and into the linear fuel passages. The fuel flowing in the linear fuel passages removes some of the heat transferred to the linear fuel passages and prevents the temperature from rising during a high power operation. However, when the flow of fuel is reduced after a high power operation, such as during descent of an aircraft, the temperature within the linear fuel passages may increase. This can lead to coke formation within the linear fuel passages and the blocking or plugging of the linear fuel passages and/or the nozzle tip.

The helical configuration of the one or more fuel passages 32 disclosed herein may assist in the thermal management of heat flows to the fuel passages 32. The total length of the helical fuel passages 32 (e.g. the FPL) is greater than that of conventional linear fuel passages over stem bodies having the same length, and thus the volume of the helical fuel passages 32 is greater than that of conventional linear fuel passages. The ratio of fuel passage volume to stem volume is therefore greater with the helical fuel passages 32 than it is with conventional linear fuel passages. This increased volumetric ratio may assist in the thermal management of heat flows to the fuel passages 32. Furthermore, the helical fuel passages 32 provide a longer fuel passage length FPL for the fuel 13 to flow along when compared to the length of conventional linear fuel passages, which may be similar to the axial length of the stem. The increased fuel passage length FPL over which the fuel travels may help to remove heat from the fuel passage 32. This may result in the fuel 13 having a slightly reduced temperature when it reaches the nozzle tip 26 when compared to conventional linear fuel passages over some power conditions.

Still referring to FIGS. 3A to 3C, the fuel passage 32 defines a fuel passage center axis 38 (see FIG. 2A also). The fuel passage center axis 38 is a longitudinal, curved center axis for the fuel passage 32. The fuel center passage axis 38 (sometimes referred to herein simply as "fuel passage axis 38") therefore also circumferentially winds, or spirals, through the stem body 28. The fuel passage axis 38 is spaced a radial distance D from the stem center axis 30. The radial distance D is measured along a line starting from the stem center axis 30 and being normal thereto, and extending to the helical fuel passages axis 38 at any point thereon. The radial distance D is selected in order to position the fuel passage axis 38, and thus the fuel passage 32, as close as possible to the stem center axis 30. The radial distance D is therefore selected to be minimal. In the depicted embodiment, the radial distance D is constant over the fuel passage length FPL. The fuel passage 32 therefore does not spiral radially outwardly about its passage axis 36. In the depicted embodiment, the fuel passage 32 is the component of the stem 24 that is closest to the stem center axis 30. Other components of the stem 24 are disposed radially further away from the stem center axis 30 than the fuel passage 32. Positioning the fuel passage 32 as close as possible to the center of the stem 24 is believed to better insulate the fuel passage 32 from the hot environment surrounding the fuel nozzle 20. This insulated position of the fuel passage 32 may reduce the heat transferred thereto.

FIGS. 3A to 3C show that the stem 24 of the depicted embodiment is an assembly of components. More particularly, the stem 24 includes one or more outer, tubular sleeves 25 disposed about the stem body 28. The outer sleeve 25 is coaxial with the stem body 28. In the depicted embodiment, the outer sleeve 25 acts as a heat shield to insulate the stem body 28. An annular air passage 27 of the fuel nozzle 20 is defined between a radially-inner surface 25A of the outer sleeve 25 and the outer surface 34 of the stem body 28.

Figure 4A:
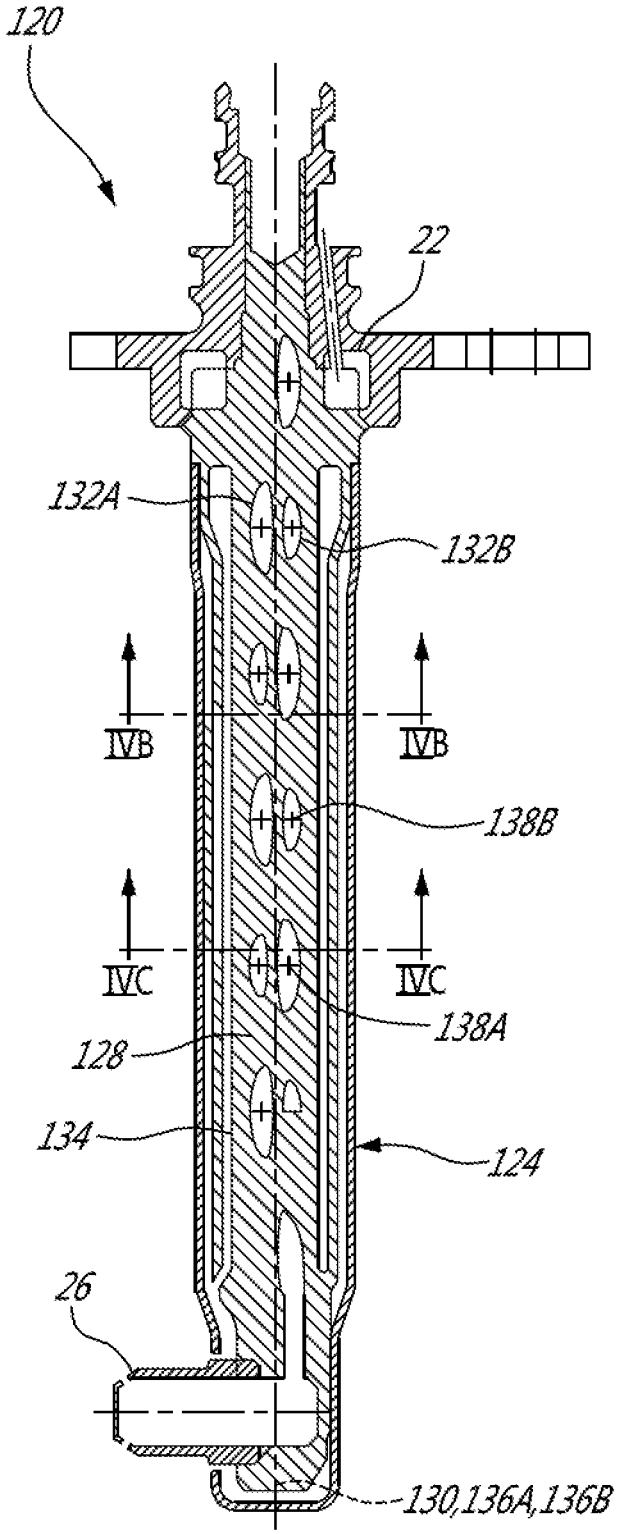
FIG. 4A is a cross-sectional view of a stem of the fuel nozzle of FIG. 1B, in accordance with another aspect of the present disclosure.
Figure 4B:
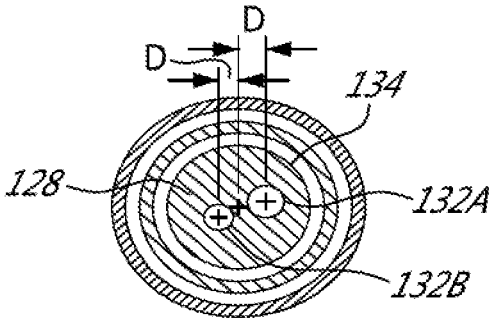
FIG. 4B is a cross-sectional view of the stem of the fuel nozzle of FIG. 4A, taken along the line IVB-IVB in FIG. 4A.
Figure 4C:
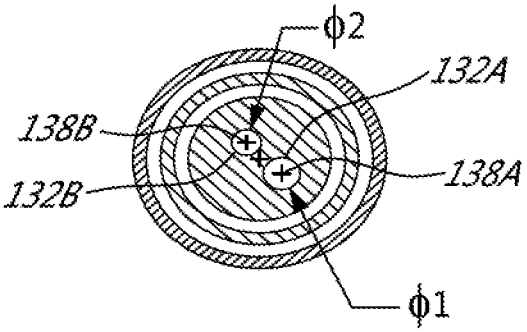
FIG. 4C is a cross-sectional view of the fuel nozzle of FIG. 4A, taken along the line IVC-IVC in FIG. 4A.

FIGS. 4A to 4C show another embodiment of the fuel nozzle 120. The fuel nozzle 120 has many of the same features as the fuel nozzle 20 described above. Therefore, reference to features of the fuel nozzle 120 that are the same or similar to those of the fuel nozzle 20 will be understand to include the functionality, attributes, and variants of those features described above.

The fuel nozzle 120 has more than one fuel passage 132. More particularly, the stem body 128 of the fuel nozzle 120 has a first fuel passage 132A and a second fuel passage 132B. Each of the first and second fuel passages 132A, 132B is spaced radially inwardly from the outer surface 134 of the stem body 128, and is therefore thermally insulated by the radial thickness of the stem body 128. The first and second fuel passages 132A, 132B are separate fluid conduits. The fuel 13 conveyed through one of the first and second fuel passages 132A, 132B does not mix with the fuel 13 conveyed in the other of the first and second fluid passages 132A, 132B.

The first and second helical fuel passages 132A, 132B and their fuel passage axes 138A, 138B spiral through the stem body 128 forming at least one revolution over the axial length AL of the stem body 128. In the depicted embodiment, the passage axes 136A, 136B of each of the first and second fuel passages 132A, 132B is collinear with the stem center axis 130. In the depicted embodiment, therefore, each of the first and second fuel passages 132A, 132B and their fuel passage axes 138A, 138B spiral and helically extend through the stem body 128 about the stem center axis 130 over the axial length AL of the stem body 128. It can therefore be appreciated that the first and second fuel passages 132A, 132B are intertwined about a common center axis (i.e. the stem center axis 130) of the fuel nozzle 120.

Still referring to FIGS. 4A to 4C, the first and second fuel passages 132A, 132B are intertwined about the stem center axis 130 in a helical configuration or orientation. This helical configuration helps to position both of the first and second fuel passages 132A, 132B as close as possible to the stem center axis 130. The proximity of the first and second fuel passages 132A, 132B to the stem center axis 130 may help to limit the heat transfer thereto from the environment surrounding the fuel nozzle 120. In the depicted embodiment the helical first and second fuel passages 132A, 132B form a "double helix" configuration of the fuel passages 132A, 132B.

The radial distance D that each fuel passage axis 138A, 138B is spaced from the stem center axis 130 is constant over the axial length AL of the stem body 128, and/or over the fuel passage length FPL. Therefore, neither one of the first and second fuel passages 132A, 132B spirals radially outwardly about its passage axis 136A, 136B. In the depicted embodiment, the radial distance D has a value which is the same for each of the first and second fuel passages 132A, 132B over the axial length AL of the stem body 128. Similarly to the fuel nozzle 20 described above, the radial distance D in the embodiment of FIGS. 4A to 4C is selected in order to position the fuel passage axes 138A, 138B, and thus the first and second fuel passages 132A, 132B, as close as possible to the stem center axis 130. The radial distance D is therefore selected to be minimal. In the depicted embodiment, the first and second fuel passages 132A, 132B are the components of the stem 124 that are closest to the stem center axis 130. Other components of the stem 124 are disposed radially further away from the stem center axis 130 than the first and second fuel passages 132A, 132B. Positioning the first and second fuel passages 132A, 132B as close as possible to the center of the stem 124 is believed to better insulate the first and second fuel passages 132A, 132B from the hot environment surrounding the fuel nozzle 120. This insulated position of the first and second fuel passages 132A, 132B may reduce the heat transferred thereto. In an alternate embodiment, and as described in greater detail below, the radial distance D of the first and second fuel passages 132A, 132B is not constant.

In the depicted embodiment, and similar to the nozzle 20 described above, the stem body 128 is a monolithic, solid body. The stem body 128 is free of any apertures or grooves except for the first and second fuel passages 132A, 132B. Referring to FIG. 4C, the first fuel passage 132A has a first passage diameter ø1 and the second fuel passage 132B has a second passage diameter ø2. The first passage diameter ø1 is greater than the second passage diameter ø2. In the depicted embodiment, one of the fuel passages 132A, 132B may be a primary fuel passage and the other fuel passage 132A, 132B may be a secondary fuel passage. The primary fuel passage has near constant flow of fuel 13 therein, while the secondary fuel passage allows for intermittent flow of the fuel 13. Because of the intermittent flow of fuel 13 therein, the secondary fuel passage may be more prone to coke formation. Therefore, in order to improve heat management and reduce coke formation, the secondary fuel passage (in this embodiment, the first fuel passage 132A) is provided with a greater passage diameter ø1 to provide the first fuel passage 132A with a greater internal surface area to better manage heat transfer to the fuel 13 therein.

Figure 5A:
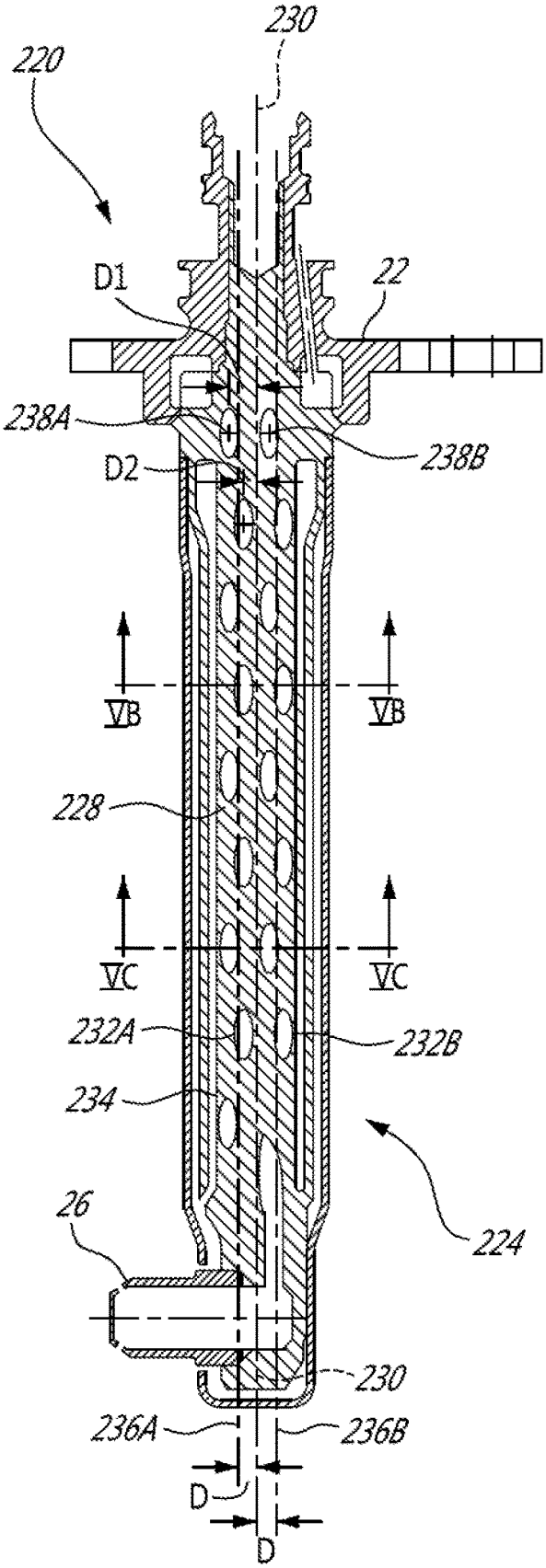
FIG. 5A is a cross-sectional view of a stem of the fuel nozzle of FIG. 1B, according to a further embodiment of the present disclosure.
Figure 5B:
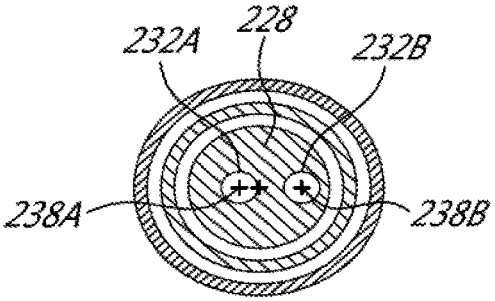
FIG. 5B is a cross-sectional view of the stem of the fuel nozzle of FIG. 5A, taken along the line VB-VB in FIG. 5A.
Figure 5C:
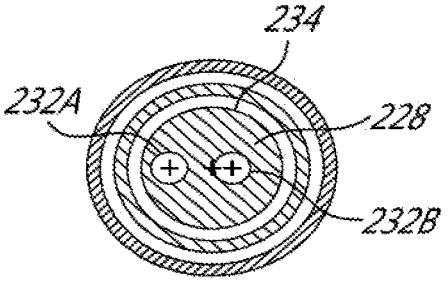
FIG. 5C is a cross-sectional view of the stem of the fuel nozzle of FIG. 5A, taken along the line VC-VC in FIG. 5A.

FIGS. 5A to 5C show another embodiment of the fuel nozzle 220. The fuel nozzle 220 has many of the same features as the fuel nozzle 20, 120 described above. Therefore, reference to features of the fuel nozzle 220 that are the same or similar to those of the fuel nozzle 20, 120 will be understand to include the functionality, attributes, and variants of those features described above.

The fuel nozzle 220 has more than one fuel passage 232. More particularly, the stem body 228 of the fuel nozzle 220 has a first fuel passage 232A and a second fuel passage 232B. Each of the first and second fuel passages 232A, 232B is spaced radially inwardly from the outer surface 234 of the stem body 228, and is therefore thermally insulated by the radial thickness of the stem body 228. The first and second fuel passages 232A, 232B are separate fluid conduits. The fuel 13 conveyed through one of the first and second fuel passages 232A, 232B does not mix with the fuel 13 conveyed in the other of the first and second fluid passages 232A, 232B.

The first and second helical fuel passages 232A, 232B and their fuel passage axes 238A, 238B helically extend through the stem body 228 forming at least one revolution over the axial length AL of the stem body 228. In the depicted embodiment, the passage axes 236A, 236B of each of the first and second fuel passages 232A, 232B are not collinear with the stem center axis 230. More particularly, in the depicted embodiment, the passage axes 236A, 236B are parallel to the stem center axis 230 and radially spaced apart therefrom. Each passage axis 236A, 236B is spaced a non-zero radial distance D from the stem center axis 130. Therefore, each of the first and second fuel passages 232A, 232B and their fuel passage axes 238A, 238B helically extend through the stem body 228 parallel to one another and radially spaced apart from one another. Both the first and second fuel passages 232A, 232B spiral about their passage axis 236A, 236B in a helical configuration or orientation.

Still referring to FIGS. 5A to 5C, the radial distance D that each fuel passage axis 238A, 238B is spaced from the stem center axis 230 is not constant, and varies over the axial length AL of the stem body 228, and/or over the fuel passage length FPL. Each fuel passage 232A, 232B has an outer radial distance D1 and an inner radial distance D2, where the outer radial distance D1 is greater than the inner radial distance D2. For each fuel passage 232A, 232B, the values of the outer and inner radial distances D1, D2 remain constant over the axial length AL of the stem body 228, and/or over the fuel passage length FPL. Therefore, neither one of the first and second fuel passages 232A, 232B spirals radially outwardly about its passage axis 236A, 236B. In the depicted embodiment, the first and second fuel passages 232A, 232B are the components of the stem 224 that are closest to the stem center axis 230. Other components of the stem 224 are disposed radially further away from the stem center axis 230 than the first and second fuel passages 232A, 232B. In the depicted embodiment, and similar to the nozzle 20, 120 described above, the stem body 228 is a monolithic, solid body. The stem body 228 is free of any apertures or grooves except for the first and second fuel passages 232A, 232B.

Referring to FIGS. 3A to 3C, there is also disclosed a method of manufacturing the fuel nozzle 20. The method includes forming the monolithic stem body 28. The method also includes integrally forming at least one internal helical fuel passage 32 extending helically within the monolithic stem body 28. Additive manufacturing is believed to allow intricate internal shapes, such as the helical contours of the at least one fuel passage 32, to be formed through the deposition of material in layers. The method therefore provides an arrangement for the fuel passages 32 that takes advantage of the capabilities of additive manufacturing.

The above description is meant to be exemplary only, and one skilled in the art will recognize that changes may be made to the embodiments described. For example, although described and shown herein as following a substantially circular or elliptical winding path, it will be appreciated that the fuel passage 32, 132, 232 may have a more linear or angular winding path through the stem body 28, 128, 228. Still other modifications will be apparent to those skilled in the art, in light of a review of this disclosure.

The invention claimed is:

1. A fuel nozzle for a gas turbine engine, the fuel nozzle comprising: a stem having a monolithic stem body extending longitudinally between a first end and a second end, the monolithic stem body having a radially outer surface, a first helical fuel passage and a second helical fuel passage, the first helical fuel passage and the second helical fuel passages each extending helically through the monolithic stem body about a passage axis extending between the first and second ends, the first and second helical fuel passages disposed inwardly from the radial outer surface, each of the first and second helical fuel passages having a fuel passage center axis extending through the monolithic stem body about a respective one of said passage axis, the passage axis of each of the first and second helical fuel passages being parallel to a stem center axis of the monolithic stem body, each said passage axis being spaced a radial distance from the stem center axis and from each other.

2. The fuel nozzle as defined in claim 1, wherein the fuel passage center axis of each of the first and second helical fuel passages is spaced a radial distance from the stem center axis, the radial distance being minimized such that the first and second helical fuel passages are disposed radially closest to the stem center axis compared to other components of the fuel nozzle.

3. The fuel nozzle as defined in claim 1, wherein one or both of the first and second helical fuel passages have a fuel passage length greater than an axial length of the monolithic stem body.

4. The fuel nozzle as defined in claim 1, wherein the fuel passage center axis of each of the first and second helical fuel passages is spaced a radial distance from the stem center axis, the radial distance for each of the first and second helical fuel passages being constant over an axial length of the monolithic stem body.

5. The fuel nozzle as defined in claim 4, wherein the radial distance between the stem center axis and the fuel passage center axis of each of the first and second helical fuel passages is equal.

6. The fuel nozzle as defined in claim 5, wherein the first and second helical fuel passages form a double helix passage configuration in the monolithic stem body.

7. The fuel nozzle as defined in claim 1, wherein the first helical fuel passage has a first passage diameter and the second helical fuel passage has a second passage diameter, the first passage diameter being greater than the second passage diameter.

8. The fuel nozzle as defined in claim 1, wherein a pitch of the first and second helical fuel passages is defined as a number of revolutions of the first and second helical fuel passages over a unit length, the pitch of one or both of the first and second helical fuel passages being constant over at least part of an axial length of the monolithic stem body.

9. The fuel nozzle as defined in claim 1, wherein the monolithic stem body is solid and free of any apertures therein except for the first and second helical fuel passages.

10. The fuel nozzle as defined in claim 1, wherein the stem includes at least one outer sleeve disposed about the monolithic stem body, an annular air passage of the fuel nozzle being defined between a radially-inner surface of the outer sleeve and the outer surface of the monolithic stem body.

11. A gas turbine engine, comprising:

an annular engine case, and a combustor; and fuel nozzle, comprising: a flange secured to the engine case, and a stem extending from the flange to a distal nozzle tip extending through an opening in the combustor, the stem having a monolithic stem body having a radially outer surface, first helical fuel passage and a second helical fuel passage, each of the first and second helical fuel passages extending helically through the monolithic stem body about a passage axis extending between the first and second ends, the first and second helical fuel passages disposed inwardly from the radial outer surface, each of the first and second helical fuel passages having a fuel passage center axis extending through the monolithic stem body about a respective one of said passage axis, the passage axis of each of the first and second helical fuel passages being parallel to a stem center axis of the monolithic stem body, each passage axis being spaced a radial distance from the stem center axis and from each other.

12. The gas turbine engine as defined in claim 11, wherein the first and second helical fuel passages form a double helix passage configuration in the monolithic stem body.

13. The gas turbine engine as defined in claim 11, wherein the fuel passage center axis of each of the first and second helical fuel passages is spaced a radial distance from the stem center axis, the radial distance for each of the first and second helical fuel passages being constant over an axial length of the monolithic stem body.

14. The gas turbine engine as defined in claim 13, wherein the radial distance between the stem center axis and the fuel passage center axis of each of the first and second helical fuel passages is equal.

15. The gas turbine engine as defined in claim 11, wherein a pitch of the first and second helical fuel passages is defined as a number of revolutions of the first and second helical fuel passages over a unit length, the pitch of one or both of the first and second helical fuel passages being constant over at least part of an axial length of the monolithic stem body.

16. A method of manufacturing a fuel nozzle for a gas turbine engine, the method comprising:

forming a monolithic stem body, the monolithic stem body extending axially along a longitudinal stem axis between an outer end and an inner end, the outer end having a fuel inlet and adapted to be secured to a casing of the gas turbine engine and the inner end having a spray tip of the fuel nozzle mounted thereto, including integrally forming first and second internal helical fuel passages within the monolithic stem body, the internal helical fuel passages extending axially through the monolithic stem body between the fuel inlet and the spray tip, the internal helical fuel passages disposed radially inwardly from a radially-outer surface of the monolithic stem body and extending helically about a passage axis extending between the fuel inlet and the spray tip, the passage axis of each of the first and second helical fuel passages being parallel to the longitudinal stem axis of the monolithic stem body, each passage axis being spaced a radial distance from the longitudinal stem axis and from each other.

17. The method as defined in claim 16, further comprising using additive manufacturing to form the monolithic stem body and the internal helical fuel passages integrally formed therein.

* * * * *